US005332110A

United States Patent [19]

Forsyth

[11] Patent Number: 5,332,110

[45] Date of Patent: Jul. 26, 1994

[54] TRACTOR MOUNTED HYDRAULIC PIPELAYER WITH SIDE BOOM

[75] Inventor: Raymond Forsyth, North Vancouver, Canada

[73] Assignee: Vanguard Hydraulic Pipelayer, Canada

[21] Appl. No.: 20,652

[22] Filed: Feb. 22, 1993

[51] Int. Cl.[5] ..... B66C 13/42

[52] U.S. Cl. ..... 212/258; 212/151; 212/163

[58] Field of Search ..... 212/151, 152, 196, 258, 212/162, 163, 164, 172

[56] References Cited

U.S. PATENT DOCUMENTS

| | | | |
|---|---|---|---|
| 2,712,873 | 7/1955 | Peterson | 212/258 |
| 2,840,244 | 6/1958 | Thomas | 212/152 |
| 3,005,559 | 10/1961 | Toderick | 212/152 |
| 3,055,511 | 9/1962 | Sharp | 212/151 |
| 3,598,347 | 8/1971 | Marburger | 212/258 |
| 3,785,503 | 1/1974 | Butterfield et al. | 212/172 |
| 3,938,669 | 2/1976 | Vinton | 212/162 |
| 3,990,583 | 11/1976 | Nishida et al. | 212/258 |
| 4,132,317 | 1/1979 | Arendt et al. | 212/258 |
| 4,598,829 | 7/1986 | Young et al. | 212/151 |
| 4,687,406 | 8/1987 | Kinsey | 212/151 |

FOREIGN PATENT DOCUMENTS

| | | | |
|---|---|---|---|
| 1186447 | 4/1970 | United Kingdom | 212/154 |

OTHER PUBLICATIONS

*Caterpillar 561D Pipelayer*, (brochure) Caterpillar Tractor Company Feb., 1980.

*Midwestern CAT DH4 Pipelayer*, (brochure) Midwestern Manufacturing Company/Tulsa, Okla. Oct. 1, 1988.

*Midwestern's New 45,000 Lb. Lift Capacity Hydraulic Pipelayer*, (brochure) Midwestern Manufacturing Company/Tulsa, Okla. Jan. 1, 1982.

*Primary Examiner*—Michael S. Huppert
*Assistant Examiner*—Thomas J. Brahan
*Attorney, Agent, or Firm*—Emrich & Dithmar

[57] ABSTRACT

A tractor having a pair of endless, segmented, high drive tracks includes a side boom and a side-mounted counterweight. Boom angle is controlled by a boom winch with a load winch provided for lifting a load. Both winches are hydraulically driven and provide positive drive in raising and lowering. A boom automatic stop arrangement detects full-up boom position and actuates a release valve for dumping hydraulic pressure and preventing further retraction of the boom. The counterweight is pivotally coupled to the tractor by means of a support frame which provides for outward and upward as well as downward and inward displacement of the counterweight over an arc-like path to compensate for boom inclination and the weight of a load.

5 Claims, 8 Drawing Sheets

TRACTOR MOUNTED HYDRAULIC PIPELAYER WITH SIDE BOOM

FIELD OF THE INVENTION

This invention relates generally to apparatus for laying pipe and is particularly directed to a pipelayer attachment for a tracked vehicle employing a side boom.

BACKGROUND OF THE INVENTION

A common approach for laying pipe employs a diesel powered tracked vehicle having a side boom for positioning the pipe in or on the ground. With the boom positioned on one side of the tractor, a counterweight is typically provided on the opposing side of the tractor to compensate for the weight of the pipe. The tractor typically includes a closed, pressurized hydraulic system for pipelayer control. The tractor travels generally parallel with the pipeline, with its offset position from the pipeline changing with conditions such as a terrain, obstacles, etc. The position of the counterweight is adjusted in accordance with the weight of the pipe and the inclination of the boom. Prior approaches have met with only limited success in this area. In addition, with the increasing size of pipelaying structures to accommodate larger and heavier pipes, the capacity of the load and boom motors has correspondingly increased. As a result, retraction of the boom to the full-up position by a high powered winch system frequently results in damage to the boom as well as to its mounting hardware. Finally, current pipelayers raise the load either mechanically or hydraulically and lower the load by mechanically or hydraulically braking either the load or boom winch or by means of a counterbalance valve. If the brake is not properly adjusted in retarding winch rotation, the operator can lose the load resulting in a dangerous situation and possibly damage to the pipe.

The present invention addresses the aforementioned limitations of the prior art by providing a tractor mounted hydraulic pipelayer with a side boom which prevents over-rotation of the boom, applies positive drive to both the boom and load winches during lifting and lowering, and orients and positions the counterweight to provide a high degree of tractor stability and a high level of safety.

OBJECTS AND SUMMARY OF THE INVENTION

Accordingly, it is an object of the present invention to provide a tractor mounted hydraulic pipelayer with a side boom and a counterweight which provides tractor stability for large lift weights at full boom "down" positions.

It is another object of the present invention to provide positive drive for load and boom lift for lowering operations using hydraulic winches.

A further object of the present invention is to provide for an automatic stop for the boom full-up position in a tractor mounted hydraulic pipelayer with a side boom for preventing boom damage.

These objects of the present invention are achieved and the disadvantages of the prior art are eliminated by apparatus mounted to a tractor for laying pipe, wherein the tractor includes a center frame with an engine and first and second track frames mounted to respective sides of the center frame and wherein each of the first and second track frames has a respective segmented, endless track attached thereto. The apparatus includes first and second support frames respectively coupled to the center frame and the first track frame and to the center frame and the second track frame and a boom pivotally coupled to the first support frame. The apparatus further includes a counterweight and coupling linkage for pivotally attaching the counterweight to the second support frame for moving the counterweight over an arc-like path between a first extended, lower position and a second retracted, higher position relative to the tractor's center frame. The apparatus further includes a hydraulic control system including a hydraulic cylinder connected to the coupling linkage and a boom winch and a load winch respectively coupled to the boom and to a load for raising and lower the boom and the load and for moving the counterweight in accordance with the weight of the load and the inclination of the boom.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIGS. *7a* and *7b* are respectively side and front views of the boom used in the tractor hydraulic pipelayer of the present invention.

DETAILED DESCRIPTION OF THE PREFERRED EMBODIMENT

Figure 1:
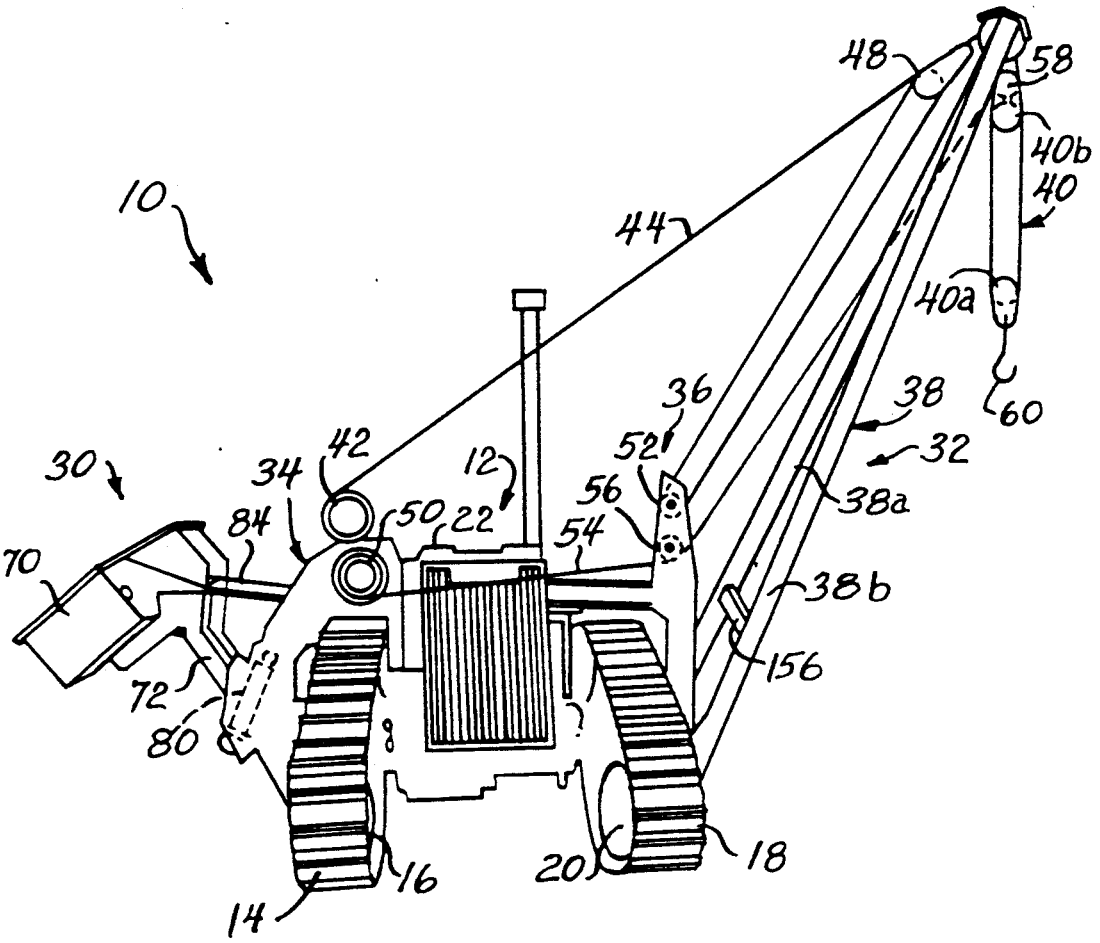
FIG. 1 is a front perspective view of a tractor mounted hydraulic pipelayer with a side boom in accordance with the present invention.

Referring to FIG. 1, there is shown a front perspective view of a tractor mounted hydraulic pipelayer 10 with a side boom 38 in accordance with the present invention. The hydraulic pipelayer 10 of the present invention is adapted for mounting to and use with a conventional tractor 12 having a center frame 22 which includes the tractor's engine, which is typically of the diesel type, and an operator station including controls necessary for the operation of the tractor and the hydraulic pipelayer. Coupled to respective sides of the tractor's center frame 22 are right and left track frames 16 and 20, where the designations "right" and "left" are taken with the tractor 12 viewed from the rear. Disposed about and coupled to the right and left track frames 16 and 20 are right and left segmented, endless tracks 14 and 18, respectively. Each of the right and left tracks 14, 18 is coupled to its respective track frame by conventional means such as of rollers and sprockets. In addition, each of the right and left tracks 14, 18 is driven by a suitable drive train coupling the tractor's engine to appropriate components in the right and left track frames 16, 20 in a conventional manner. Each of the right and left tracks 14, 18 is of the high drive type as described below.

Figure 3:
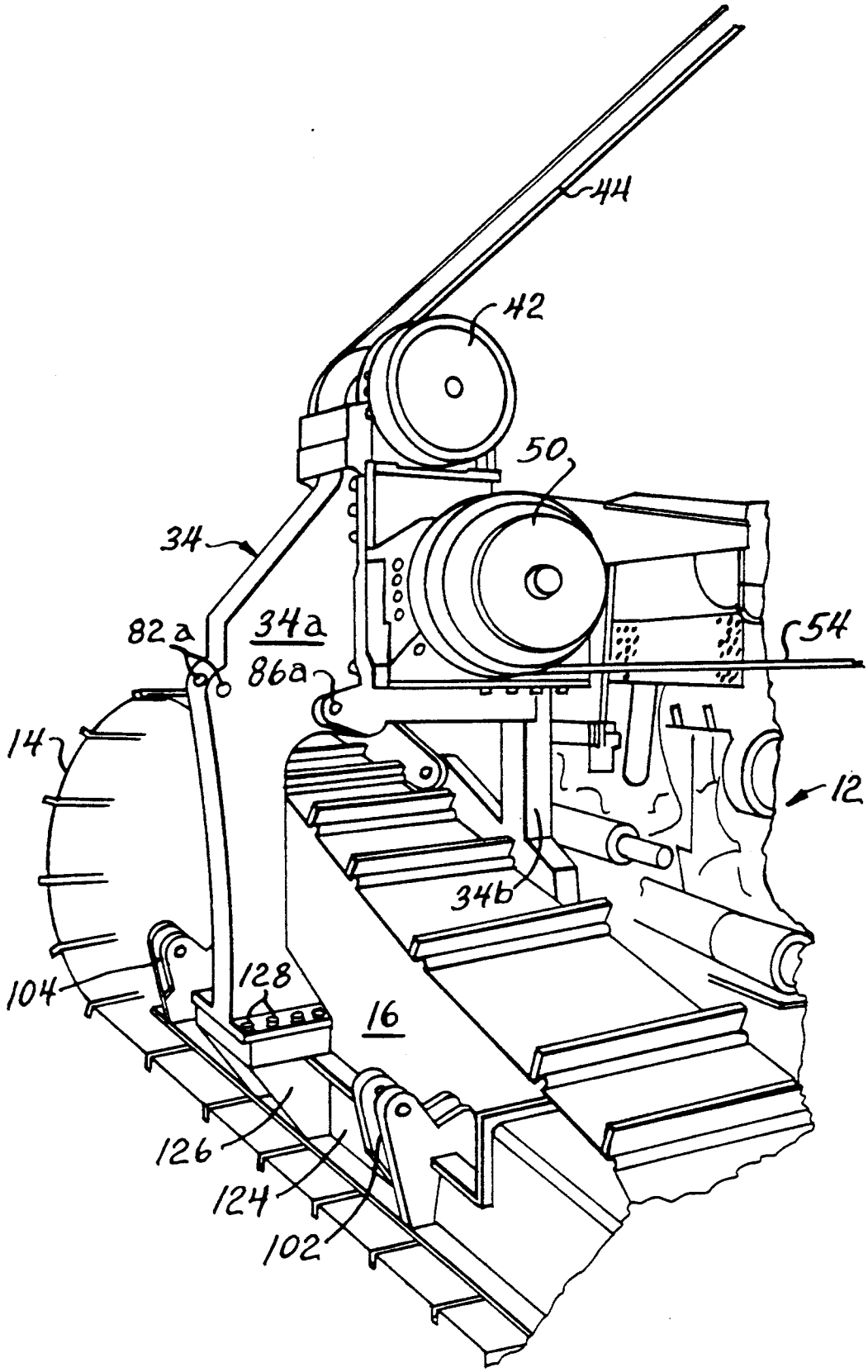
FIG. 3 is a partial perspective view showing the boom and load winches mounted to a side of the tractor.
Figure 4:
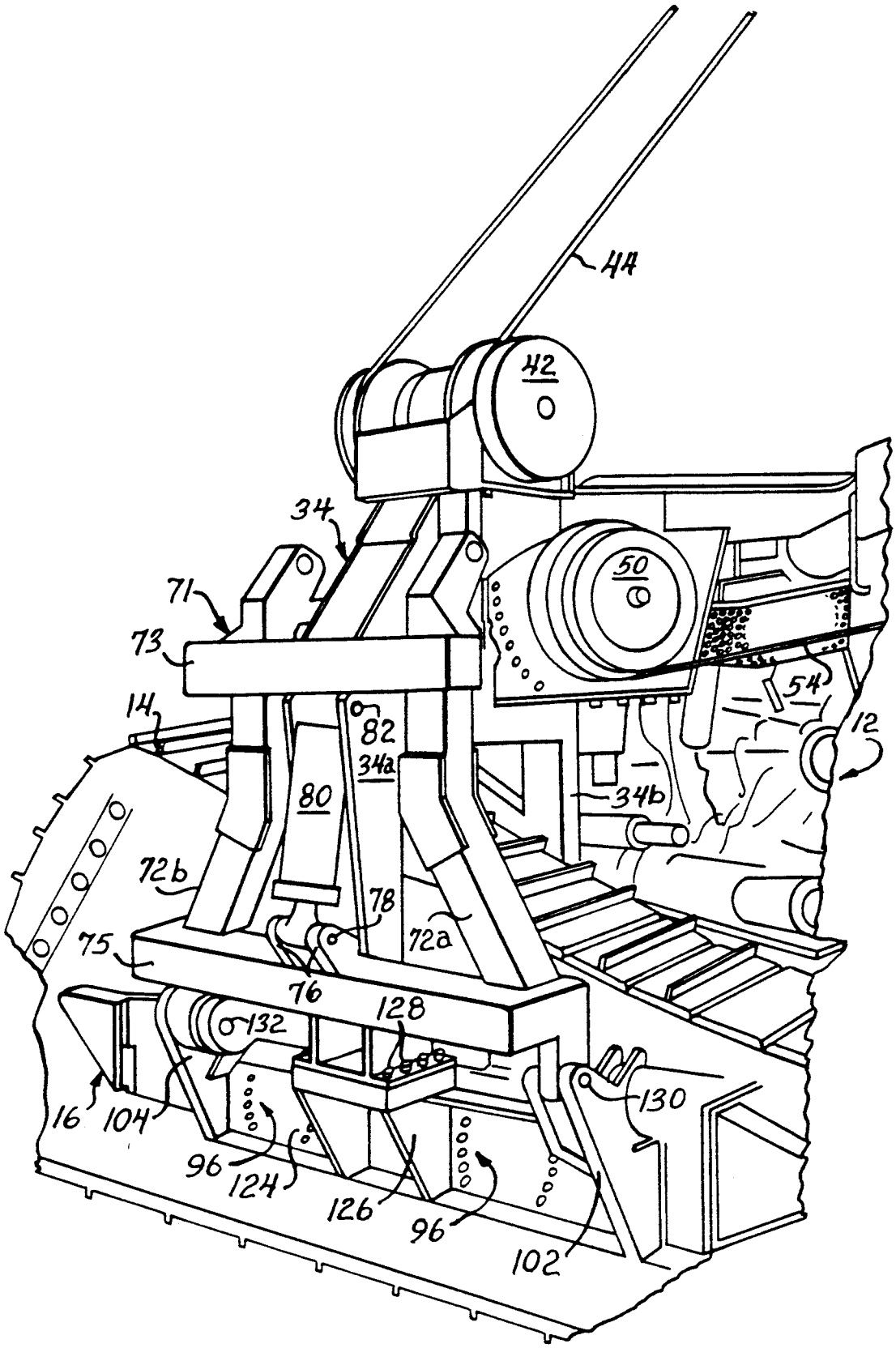
FIG. 4 is a partial perspective view showing a mounting bracket for pivotally attaching the counterweight to a side of the tractor.

With reference to FIG. 1 as well as to FIG. 2, which is a front elevation view of the hydraulic pipelayer 10 mounted to a tractor 12 with the pipelaying boom omitted for simplicity, the present invention will now be described in detail. The right and left tracks 14, 18 as well as the right and left track frames 16, 20 are shown in dotted line form in FIG. 2 to permit the components of the tractor mounted hydraulic pipelayer 10 to be emphasized. The hydraulic pipelayer 10 includes a right counterweight/winch assembly 30 and a left boom assembly 32. The right counterweight/winch assembly 30 includes a right support frame 34 comprised of an outer frame member 34*a* and an inner frame member 34*b*. Additional details of the right support frame 34 are shown in the perspective view of FIG. 3, while details of a pivoting lower support bracket 71 pivotally coupled to the right support frame 34 for supporting a counterweight are shown in FIG. 4.

A lower portion of the outer frame member 34*a* includes a mounting plate 124 securely attached to the right track frame 16 by means of a plurality of mounting bolts 96. Disposed on respective ends of mounting plate 124 are forward and aft mounting brackets 102 and 104. Each of the forward and aft mounting brackets 102, 104 is adapted to receive a respective mounting pin, or bolt, 130 and 132 for pivotally coupling the lower support bracket 71 to mounting plate 124. Mounting plate 124 further includes a center support bracket 126 to which an upper portion of the right support frame 34 is mounted by means of a plurality of bolts 128. Lower support bracket 71 is comprised of a plurality of coupled tubular members including forward and aft lower links 72*a* and 72*b*, and upper and lower cross links 73 and 75. Lower ends of the forward and aft lower links 72*a*, 72*b* are each provided with a respective aperture for receiving first and second mounting pins 130, 132, respectively. Each of the tubular members comprising the lower support bracket 71 are securely coupled together by conventional means such as weldments to provide an integrated, high strength structural member for supporting counterweight 70.

Disposed on an upper portion of the lower cross link 75 is a mounting bracket 76 for coupling the rod end of a hydraulic cylinder 80 to the lower support bracket 71 by means of coupling pin 78. The butt end of hydraulic cylinder 80 is pivotally coupled by means of a pivot pin 82 to the outer frame member 34*a* of the right support frame 34. Hydraulic cylinder 80 is coupled to the tractor's closed, pressurized hydraulic system (not shown in the figures for simplicity) for displacing the counterweight 70 as described in detail below.

The inner frame member 34*b* of the right support frame 34 is securely attached to the tractor's center frame 22 by means of a plurality of inner mounting bolts 98. The outer and inner frame members 34*a*, 34*b* are coupled by conventional means such as nut and bolt combinations, which are not shown in the figures for simplicity. Mounted to an upper portion of the inner frame member 34*b* is a boom winch 42 and a load winch 50. The boom and load winches 42, 50 are used to lift and position a load such as a pipe as described in detail below. As shown in FIGS. 3 and 4, track 14 is of the high drive type where the upper portion is inclined relative to the lower section of the track as opposed to more common track arrangement wherein the upper and lower track sections are generally parallel.

Figure 2:
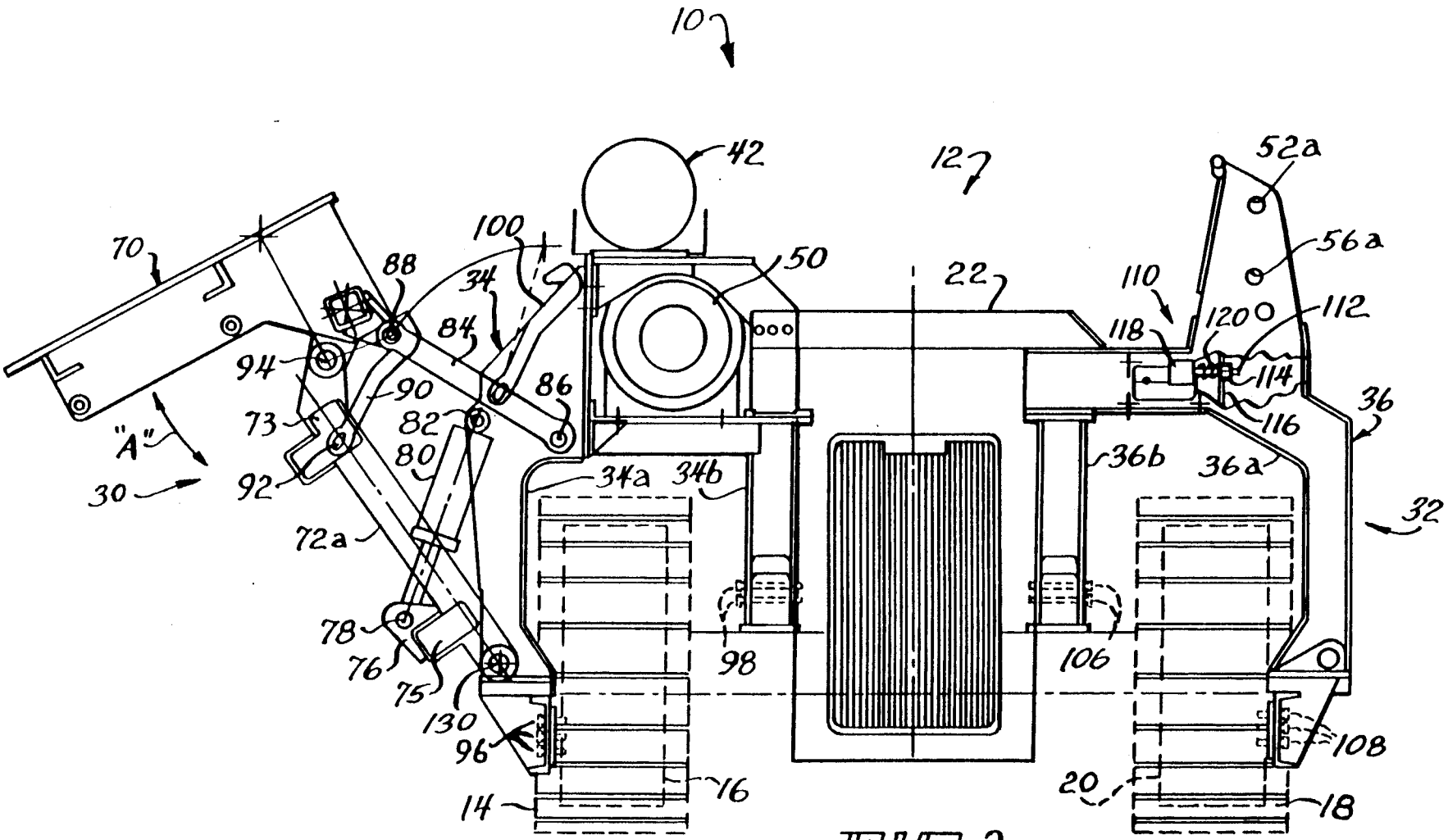
FIG. 2 is a front elevation view of the hydraulic pipelayer mounted to a tractor showing the pipelayer's counterweight and omitting its boom for simplicity.

The right counterweight/winch assembly 30 further includes a pair of spaced upper links, where a forward upper link is shown as element 84 in FIG. 2. Upper link 84 is pivotally coupled to the outer frame member 34*a* of the right support frame 34 by means of a first pivot pin 86. An outer end of the upper link 84 is pivotally coupled to counterweight 70 by means of a second pivot pin 88. A similar coupling arrangement to the outer frame member 34*a* and counterweight 70 is provided for the aft upper link which is not shown in the figures for simplicity. An outer end portion of the lower support bracket 71 is also coupled to counterweight 70 by means of a pair of pivot pins 94. A safety lockout link 90 is pivotally coupled at one end to the lower support bracket 71 by means of a pivot pin 90 and may be further coupled to counterweight 70 at its other end by means of a lock pin (not shown) for securely locking counterweight in position. This permits one to perform work beneath the elevated counterweight 70 in safety. The various aforementioned coupled links in combination with hydraulic cylinder 80 allow the counterweight 70 to be displaced outward and upward as well as inward and downward along an arc as shown by the bi-directional arrow "A" shown in FIG. 2. When boom 38 is in the "down" position or a heavy load is being lifted, counterweight 70 is displaced in a counterclockwise direction as viewed in FIG. 2 to compensate for the increased load and stabilize tractor 12 and prevent it from tipping over. Moving counterweight 70 outward away from tractor 12 and upward when lifting heavy loads particularly when the boom 38 is in a lowered position provides a high degree of stability for tractor 12 even for loads as large as 40,000 pounds (18,144 kg). Counterweight 70 is displaced in a clockwise direction as viewed in FIG. 2 when lifting heavier loads. Retracting the counterweight 70 by lowering and moving the counterweight inward toward tractor 12 substantially reduces the width of the tractor and pipelayer combination and provides improved maneuverability particularly in tight confines.

Figure 5:
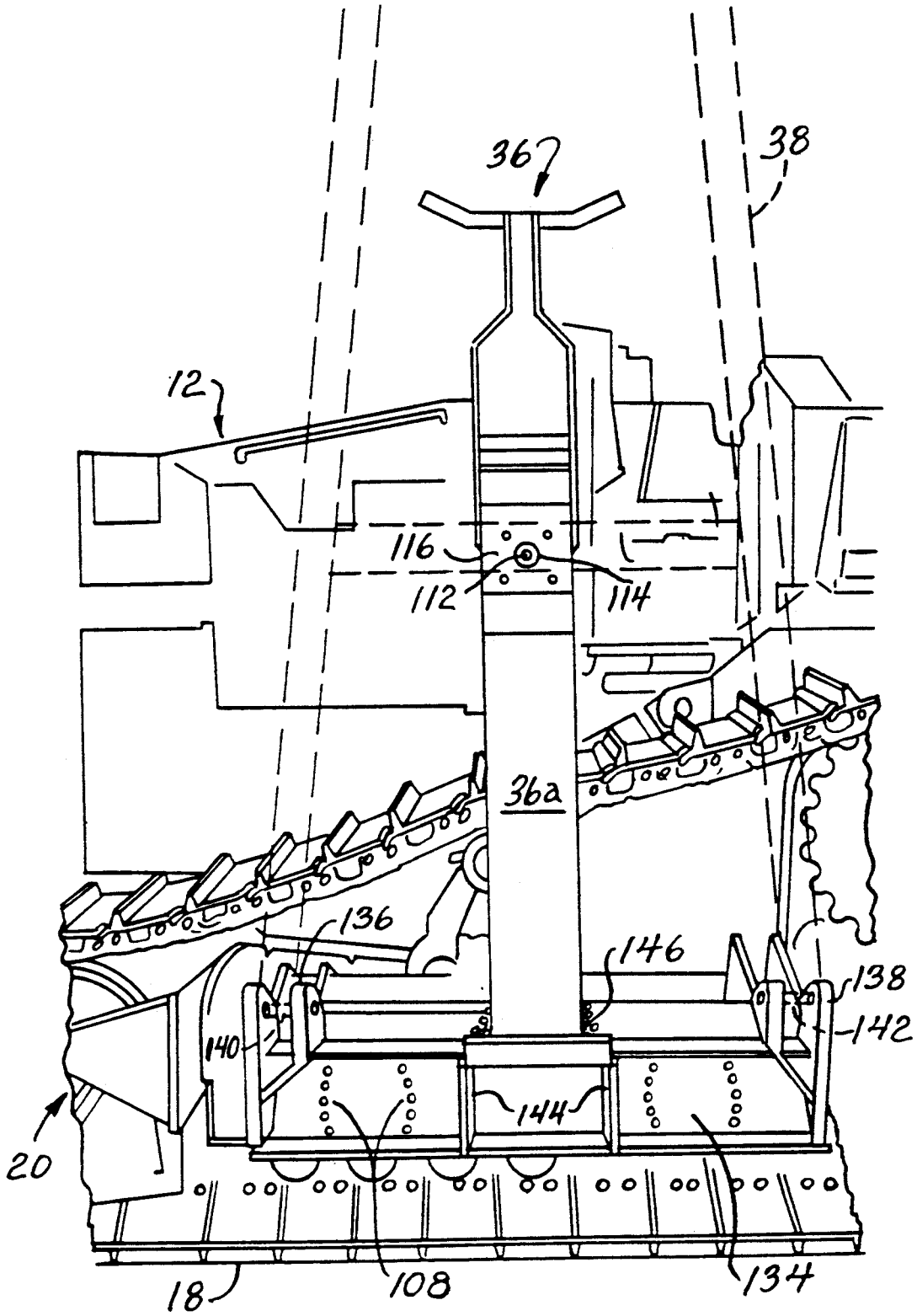
FIG. 5 is a partial side elevation view showing the boom mounting arrangement on the side of the tractor.
Figure 6:
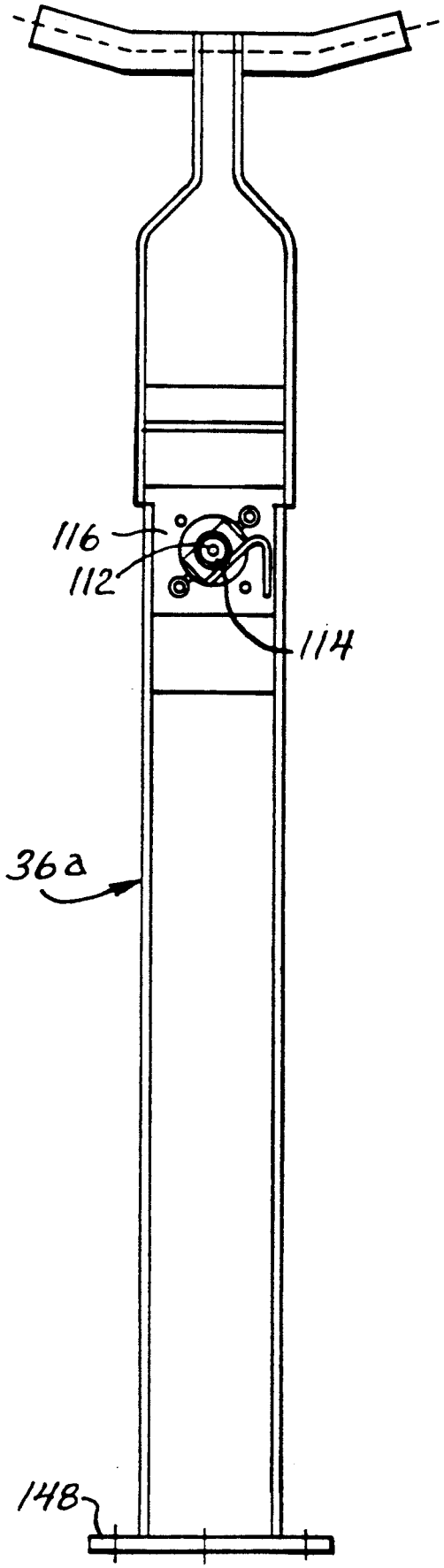
FIG. 6 is a side elevation view of a boom support frame.

Mounted to the other side of the tractor's center frame 22 is the left boom assembly 32. The left boom assembly 32 includes a left support frame 36 comprised of an outer frame member 36*a* and an inner frame member 36*b*. A side elevation view showing the left support frame 36 mounted to tractor 12 is shown in FIG. 5, while FIG. 6 is a side elevation view of the outer frame member 36*a* of the left support frame 36. Outer frame member 36*a* includes a lower mounting plate 134 for securely attaching the outer frame member to the left track frame 20 by means of a plurality of outer mounting bolts 108. Disposed on an outer, center portion of mounting plate 134 is a support bracket 144 to which is securely mounted a lower portion of the outer frame member 36*a* by means of a plurality of mounting bolts 146 and a mounting plate 148. Disposed on respective ends of the mounting plate 134 are forward and aft mounting brackets 136 and 138. Each of the forward and aft mounting brackets 136, 138 is adapted for coupling to a respective lower portion of the generally "A" shaped boom 38 by means of forward and aft mounting pins 140 and 142 ( shown in FIG. 5 in dotted line form).

An upper portion of the outer frame member 36*a* is coupled to the inner frame member 36*b* in a conventional manner such as by nut and bolt combinations which are not shown in the figures for simplicity. Inner frame member 36*b* extends downward intermediate the left track 18 and the tractor's center frame 22 and is coupled to the center frame by means of a plurality of inner mounting bolts 106. Mounted to the left support frame 36 is an automatic boom stop assembly 110 which includes a sensor shaft 112 inserted through an aperture in a vertical plate 116 and which is maintained in position by means of a mounting/alignment bracket 114. Sensor shaft 112 is movable inward and outward along its length within mounting/alignment bracket 114 and is coupled to a kickout valve 118. The sensor shaft 112 is urged in an outward direction by means of a coiled spring 120 disposed about the shaft. Raising boom 38 to the full-up position causes its cross member 156 to engage sensor shaft 112 and to displace the shaft inwardly so as to trigger the kickout valve 118. As described below, actuation of the kickout valve 118 results in a loss of hydraulic pressure which prevents further inward displacement of boom 38 for preventing damage to either the boom or to the left support frame 36. In addition, over-rotation of the boom 38 is prevented and tractor instability and the resulting unsafe situation are avoided.

Figure 7A:
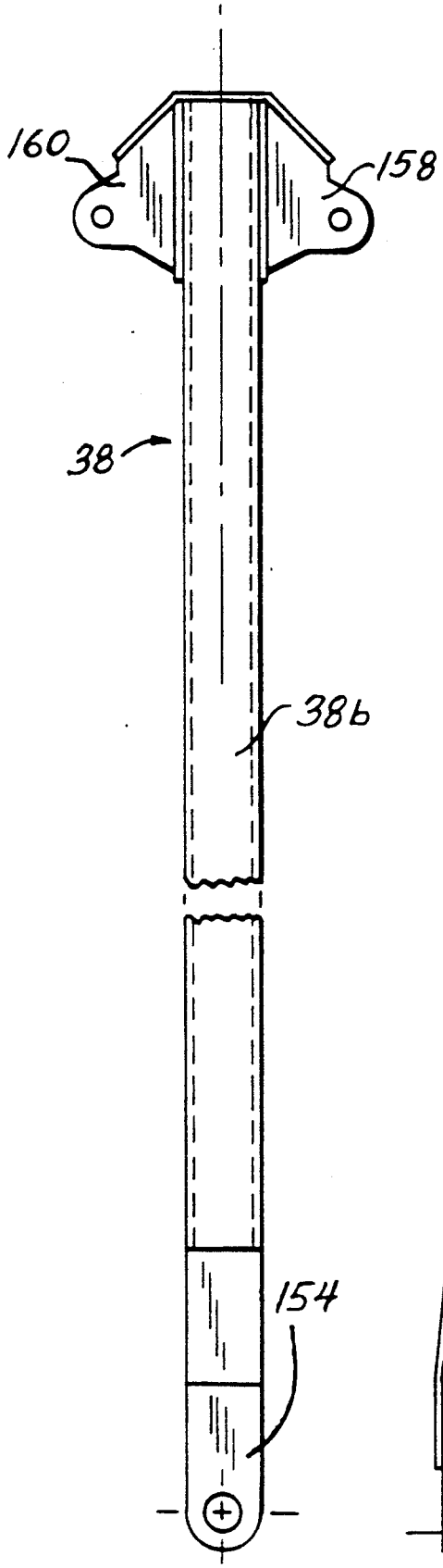
Figure 7B:
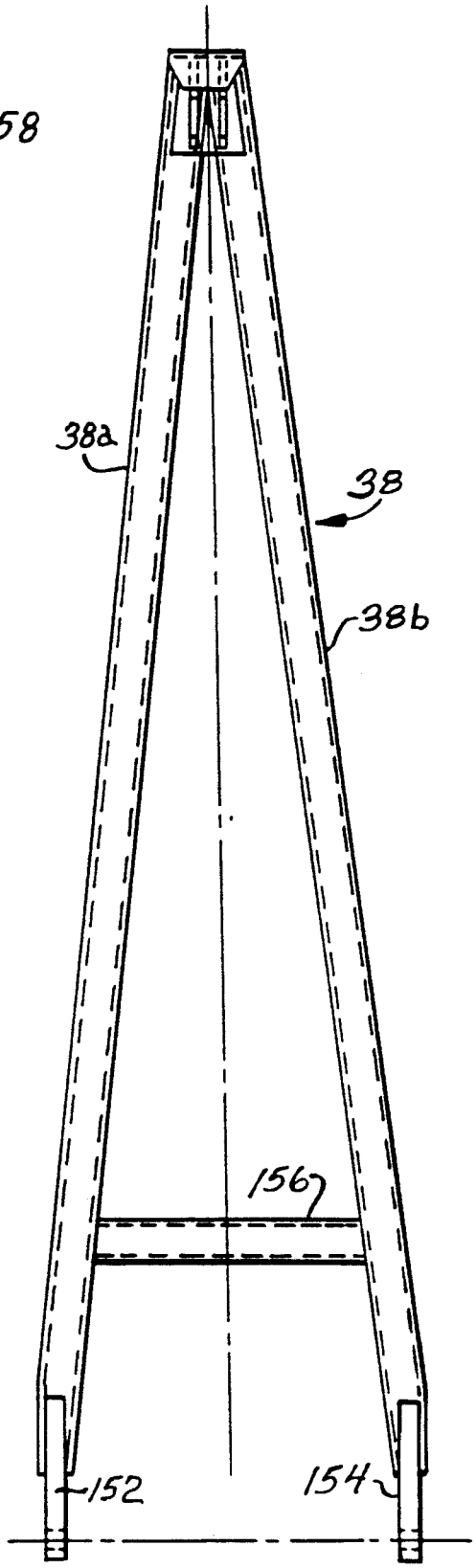

Referring to FIGS. 7*a* and 7*b*, there are respectively shown side elevation and front elevation views of the boom 38. As previously described, boom 38 is generally "A" shaped having first and second outer box beams 38*a* and 38*b* coupled at their respective upper ends. A cross member 156 connects intermediate portions of the first and second box beams 38*a*, 38*b*. First and second boom mounting brackets 152 and 154 each having a respective aperture therein are adapted for positioning in and coupling to a respective one of the forward and aft mounting brackets 136, 138 on the ends of mounting plate 134. Disposed on the upper end of boom 38 is a load block support bracket 158 and a boom block support bracket 160.

As shown particularly in FIG. 1, the boom winch 42 is coupled to a boom block 48 disposed adjacent an upper end of boom 38 by means of a boom cable 44. Boom cable 44 extends from the boom winch 42 around the boom block 48 and further around a boom sheave 52 back to the boom block to which it is connected. Boom sheave 52 is mounted by means of a shaft inserted in aligned apertures 52*a* in a upper portion of the left support frame 36. Rotation of the boom winch 42 in a first direction allows the boom 38 to be extended outwardly as it pivots about the mounting brackets 136 and 138 in mounting plate 134. Rotation of the boom winch 42 in a second, opposed direction draws the boom 38 toward the full-up position.

The load winch 50 is coupled to a hook block 40*a* having a hook 60 extending therefrom by means of a load cable 54. Load cable 54 is routed around a load sheave 56 and a load block 40*b* to the hook block 40*a*. In combination, the hook and load blocks 40*a*, 40*b*, comprise a block assembly 40 suspended by load cable 54. Rotation of the load winch 50 in a first direction raises the hook block 40*a*, while rotation of the load winch in a second, opposed direction allows for lowering of the hook block. Load sheave 56 is mounted on a shaft positioned within aligned apertures 56*a* in an upper portion of the left support frame 36.

Figure 8:
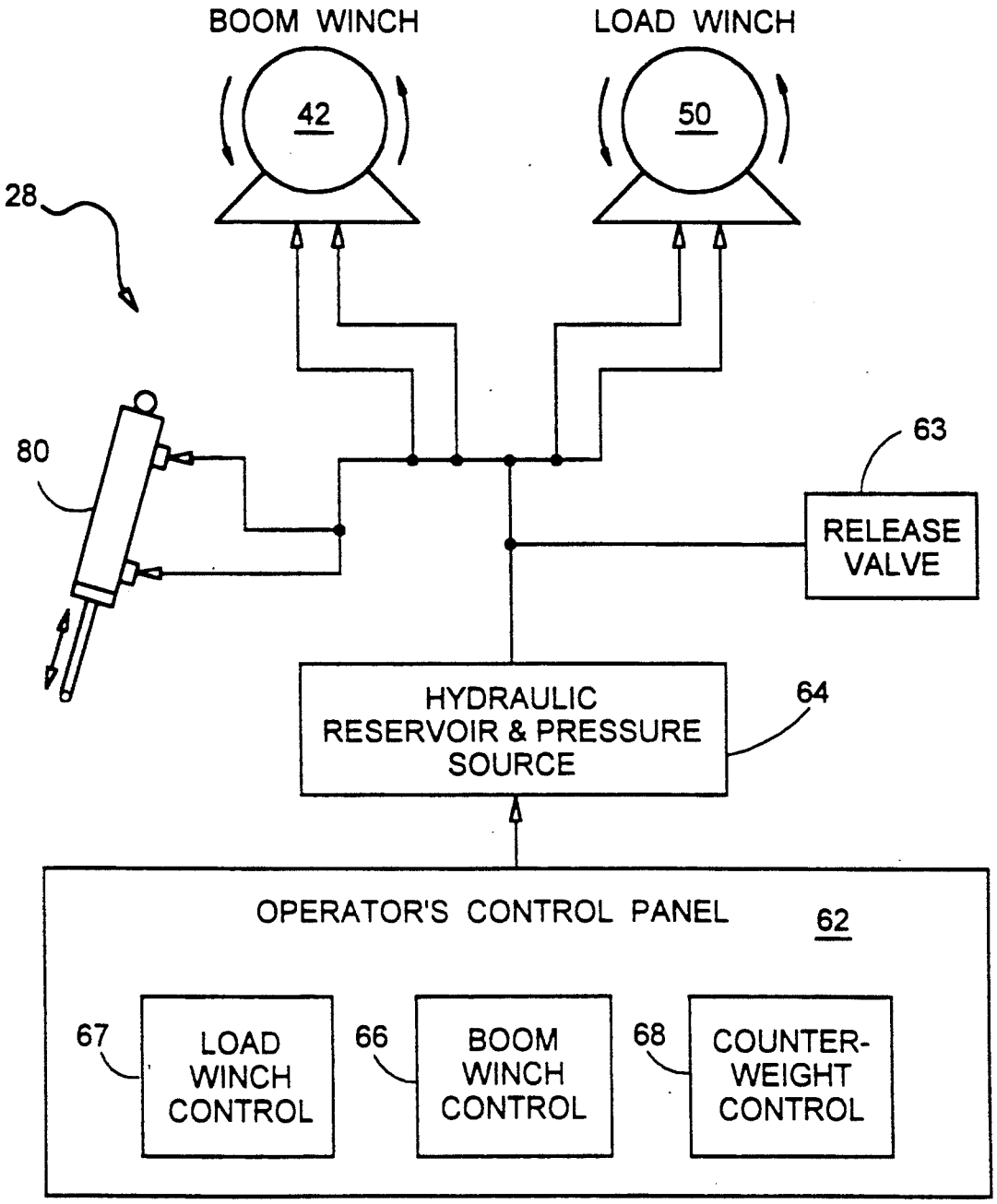
FIG. 8 is a simplified schematic and block diagram of a hydraulic system used in the tractor mounted hydraulic pipelayer with a side boom of the present invention.

Referring to FIG. 8, there is shown a simplified schematic and block diagram of a hydraulic system 28 for use in the tractor mounted pipelayer 10 of the present invention. Hydraulic system 28 includes a hydraulic reservoir and pressure source 64 coupled to the various hydraulically actuated components of the pipelayer system. Thus, cylinder 80, boom winch 42, and load winch 50 are connected in series to the hydraulic reservoir and pressure source 64. In addition, a release valve 63 is coupled to and activated by the aforementioned kickout valve 118. Release valve 63 is also coupled to the hydraulic reservoir and pressure source 64 for dumping hydraulic pressure when the kick-out valve 118 detects the boom 38 in the full-up position to prevent over-rotation of the boom. Coupled to the hydraulic reservoir and pressure source 62 is an operator's control panel 64 which includes a boom winch control 66, a load winch control 67, and a counterweight control 68. Engagement by an operator of the boom winch control 66 actuates the boom winch 42, while engagement of the load winch control 67 actuates the load winch 50. The counterweight control 68 controls the operation of the hydraulic cylinder 80 in positioning of the counterweight 70.

There has thus been shown a tractor mounted hydraulic pipelayer with a side boom and a side-mounted counterweight. Hydraulically actuated boom and load winches provide positive drive in both the raising and lowering of the boom and a load, respectively. The full-up boom position is detected by a kickout valve for automatically discharging hydraulic pressure to prevent boom over rotation. The side mounted counterweight is displaced outward and upward or inward and downward over an arc-like path to compensate for boom inclination and the weight of a load. The counterweight is at its lowest position when closest to the tractor for lowering of the center of gravity and reducing the width of the pipelayer and tractor combination for improved maneuverability. When extended from the tractor, the counterweight is elevated.

While particular embodiments of the present invention have been shown and described, it will be obvious to those skilled in the art that changes and modifications may be made without departing from the invention in its broader aspects. Therefore, the aim in the appended claims is to cover all such changes and modifications that fall within the true spirit and scope of the invention. The matter set forth in the foregoing description and accompanying drawings is offered by way of illustration only and not as limitation. The actual scope of the invention is intended to be defined in the following claims when viewed in their proper perspective based on the prior art.

I claim:

1. Apparatus mounted to a tractor for laying pipe, wherein said tractor includes a center frame with an engine and first and second track frames mounted to respective sides of said center frame, wherein each of said first and second track frames has a respective segmented, endless track attached thereto, said apparatus comprising: first and second support frames respectively coupled to the center frame and the first track frame and to the center frame and the second track frame; a boom pivotally coupled to said first support frame; a counterweight; coupling means for pivotally attaching said counterweight to said second support frame for moving said counterweight over an arc-like path between a first extended, upraised position and a second retracted, lower position relative to the tractor's center frame; a hydraulic control system including a hydraulic cylinder connected to said coupling means and a boom winch and a load winch respectively coupled to said boom and to a load for raising a lower said boom and said load and for moving said counterweight in accordance with the weight of said load and the inclination of said boom, wherein each of said boom and load winches is double acting in providing positive drive in raising and lowering said boom and said load, respectively, and wherein said load may be lowered in a controlled free-fall manner; and sensor means for detecting retraction of said boom to a full-up position and automatically preventing further retraction of said boom, wherein said sensor means includes, in combination, a movable member directly engaged by and responsive to said boom in the full-up position, a release valve connected to said hydraulic control system for dumping hydraulic pressure when said boom is in the full-up position, and mechanical kickout valve couplings said movable member to said release valve, and wherein said movable member comprises a shaft coupled to said first support frame and movable along its longitudinal axis when directly engaged by said boom.

2. The apparatus of claim 1, wherein said coupling means includes upper and lower links each pivotally coupled at respective end thereof to said second support frame and to said counterweight, and wherein said hydraulic cylinder is coupled to said lower link and to said second support frame.

3. The apparatus of claim 1, further comprising a boom cable and a load cable respectively coupling said boom winch to said boom and said load winch to said load, said apparatus further comprising a boom sheave and a load sheave respectively engaging said boom and load cables to facilitate raising and lowering of said boom and said load.

4. The apparatus of claim 3, wherein said boom and load sheaves are rotationally mounted to said first support frame.

5. The apparatus of claim 1, wherein aid tracks are of a high drive type.

* * * * *

UNITED STATES PATENT AND TRADEMARK OFFICE

CERTIFICATE OF CORRECTION

PATENT NO. : 5,332,110

DATED : July 26, 1994

INVENTOR(S) : Raymond Forsyth

It is certified that error appears in the above-identified patent and that said Letters Patent is hereby corrected as shown below:

Col. 6, line 16, "62" should be --64--; and in line 17, "64" should be --62--.

In the Claims

Col. 7, line 5, "a" should be --and--; in line 20, after "and" insert --a--; and in line 21, "couplings" should be --coupling--.

Col. 8, line 20, "aid" should be --said--.

Signed and Sealed this

Thirteenth Day of December, 1994

Bruce Lehman

*Attest:*

BRUCE LEHMAN

*Attesting Officer*

*Commissioner of Patents and Trademarks*